US010597256B2

(12) United States Patent
Jussila et al.

(10) Patent No.: US 10,597,256 B2
(45) Date of Patent: Mar. 24, 2020

(54) SAFETY CIRCUIT BOARD FOR A PASSENGER TRANSPORT INSTALLATION

(71) Applicant: KONE CORPORATION, Helsinki (FI)

(72) Inventors: Ari Jussila, Helsinki (FI); Toni Hirvonen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 16/222,631

(22) Filed: Dec. 17, 2018

(65) Prior Publication Data

US 2019/0202661 A1 Jul. 4, 2019

(30) Foreign Application Priority Data

Dec. 29, 2017 (EP) ..... 172110702

(51) Int. Cl.
*B66B 5/00* (2006.01)
*B66B 25/00* (2006.01)
(Continued)

(52) U.S. Cl.
CPC ..... *B66B 5/0031* (2013.01); *B66B 1/30* (2013.01); *B66B 1/32* (2013.01); *B66B 3/002* (2013.01);
(Continued)

(58) Field of Classification Search
CPC ..... H02P 1/00; H02P 1/04; H02P 1/46; H02P 3/00; H02P 3/04; H02P 3/06; H02P 3/065; H02P 3/12; H02P 3/14; H02P 3/16; H02P 3/18; H02P 3/20; H02P 3/22; H02P 3/24; H02P 3/26; H02P 4/00; H02P 5/00;
(Continued)

(56) References Cited

U.S. PATENT DOCUMENTS 4,367,810 A * 1/1983 Doane ..... B66B 13/18 187/280
5,407,028 A * 4/1995 Jamieson ..... B66B 5/10 187/287
(Continued)

FOREIGN PATENT DOCUMENTS

WO WO 2016/150469 A1 9/2016

OTHER PUBLICATIONS

Search Report issued in European Patent Application No. 17211070.2, dated Jul. 9, 2018.

*Primary Examiner* — Antony M Paul
(74) *Attorney, Agent, or Firm* — Birch, Stewart, Kolasch & Birch, LLP

(57) ABSTRACT

A safety circuit board for controlling an electromechanical brake and motor controller of a passenger transport installation includes at least one processing unit, a main safety output with an associated relay connected to the at least one processing unit and providing a connection to the electromechanical brake and motor, and a secondary safety output with an associated relay connected to the at least one processing unit and providing a connection to the electromechanical brake and motor. The main safety output and the secondary safety output are configured in parallel enabling control of the electromechanical brake and motor with the at least one processing unit using either of the safety outputs.

18 Claims, 1 Drawing Sheet

(51) Int. Cl.

| | |
|---|---|
| ***B66B 1/30*** | (2006.01) |
| ***B66B 1/32*** | (2006.01) |
| ***B66B 3/00*** | (2006.01) |
| ***B66B 5/02*** | (2006.01) |
| ***B66B 27/00*** | (2006.01) |

(52) U.S. Cl.
CPC ..... *B66B 5/0087* (2013.01); *B66B 5/02* (2013.01); *B66B 25/00* (2013.01); *B66B 25/006* (2013.01); *B66B 27/00* (2013.01)

(58) Field of Classification Search
CPC .... H02P 7/00; H02P 6/002; H02P 6/04; H02P 6/08; H02P 6/00; H02P 6/24; H02P 15/00; H02P 21/00; H02P 23/00; H02P 25/00; H02P 27/00; H02P 27/04; H02P 27/06; H02P 1/26; H02P 29/04; H02K 7/10; B66B 9/16
USPC ..... 318/400.01, 400.02, 400.14, 700, 701, 318/721, 727, 799, 800, 801, 362, 374, 318/375, 376; 187/223, 240, 245, 247
See application file for complete search history.

(56) References Cited

U.S. PATENT DOCUMENTS

| | | | | |
|---|---|---|---|---|
| 5,610,374 | A * | 3/1997 | Boom | G05B 19/0421 187/247 |
| 6,155,401 | A * | 12/2000 | Lunardi | B66B 23/02 198/322 |
| 7,575,102 | B2 * | 8/2009 | Matsuoka | B66B 5/0093 187/391 |
| 2018/0079622 | A1 * | 3/2018 | Sirigu | B66B 5/0031 |

* cited by examiner

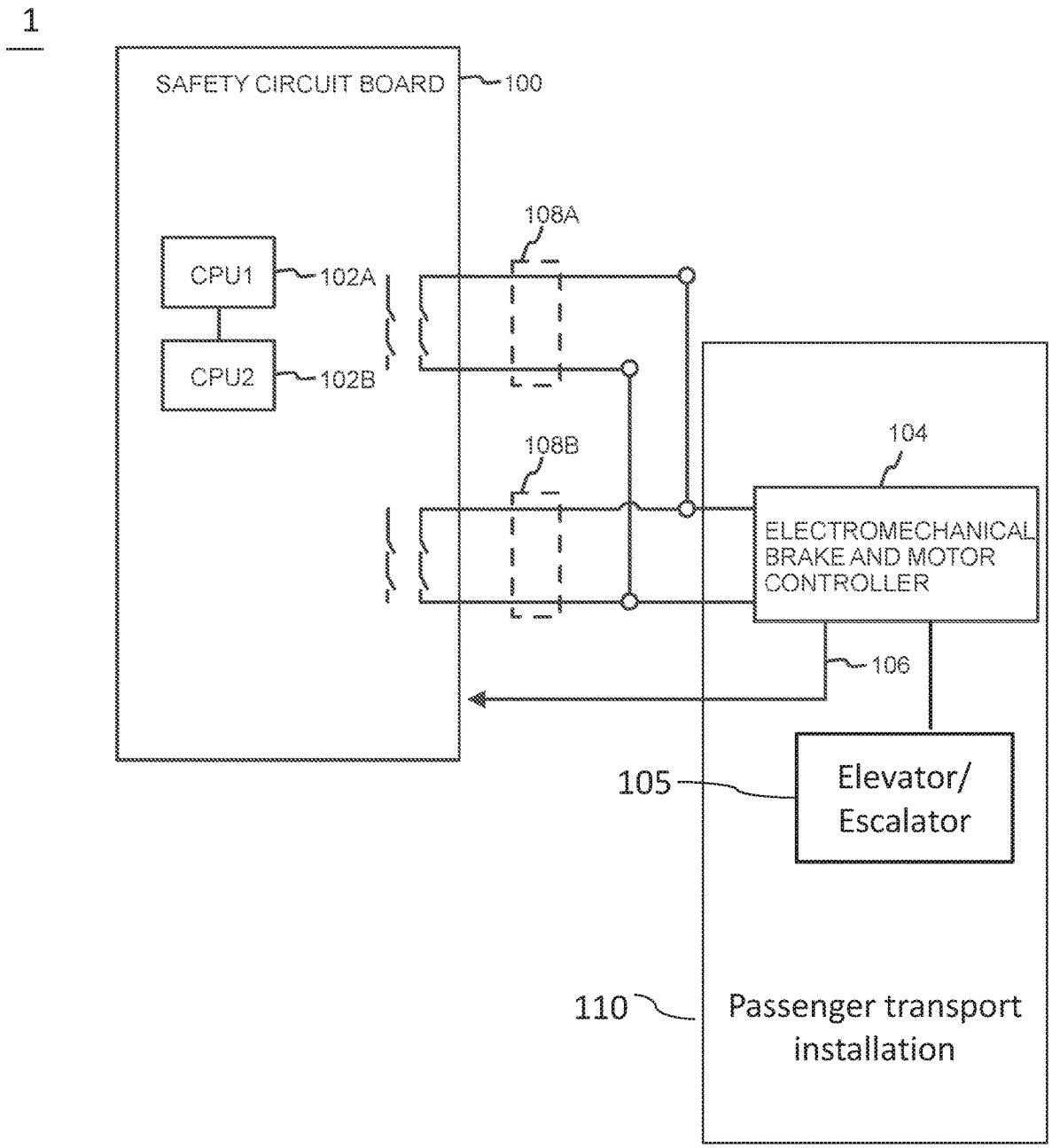
1
SAFETY CIRCUIT BOARD
100
108A
CPU1
102A
CPU2
102B
108B
104
ELECTROMECHANICAL BRAKE AND MOTOR CONTROLLER
106
105
Elevator/ Escalator
110
Passenger transport installation

SAFETY CIRCUIT BOARD FOR A PASSENGER TRANSPORT INSTALLATION

BACKGROUND

Safety is an important factor in elevator systems and escalator systems. These systems may comprise a number of safety devices providing signals for a controlling unit, for example, a safety circuit board. The controlling unit then determines whether operation of an elevator or an escalator is possible.

PESSRAL/PESSRAE (Programmable Electronic System in Safety Related Applications for Lifts/Programmable Electronic System in Safety Related Applications for Escalators) standards require that safety output relays are tested at least once a day. This means that an elevator or an escalator has to be stopped in order to perform the relay testing.

In certain locations where there is continuous heavy people traffic, escalator safety regulations may require that escalators run continuously through a service interval that can be several months long. However, in order to test a safety output relay of the escalator, the escalator must be stopped.

Thus, it would be beneficial to have a solution that would alleviate at least one of these drawbacks.

SUMMARY

According to at least some of the aspects, a solution is provided that enables performing safety output relay testing of a safety circuit while a passenger transport installation system is running.

According to a first aspect of the invention, there is provided a safety circuit board for controlling an electromechanical brake and motor of a passenger transport installation. The safety circuit controller comprises at least one processing unit, a main safety output with an associated relay connected to the at least one processing unit and providing a connection to the electromechanical brake and motor, and a secondary safety output with an associated relay connected to the at least one processing unit and providing a connection to the electromechanical brake and motor controller. The main safety output and the secondary safety output are configured in parallel enabling control of the electromechanical brake and motor controller with the at least one processing unit using either of the safety outputs.

In an embodiment, the least one processing unit is configured to alternate between the main safety output and the secondary safety output when controlling the electromechanical brake and motor controller.

In an embodiment, the at least one processing unit is configured to switch periodically, for example, every one hour between the main safety output and the secondary safety output when controlling the electromechanical brake and motor controller.

In an embodiment, alternatively or in addition, the at least one processing unit is configured to detect that a switch between the main safety output and the secondary safety output fails, and to limit the maximum usage time of the currently used safety output.

In an embodiment, alternatively or in addition, the at least one processing unit is configured to issue a request to stop the passenger transport installation in response to exceeding the maximum usage time.

In an embodiment, alternatively or in addition, the at least one processing unit is configured to use the secondary safety output as a backup safety output, detect a failure with the main safety output, and take the secondary safety output into use in response to detecting the failure with the main safety output.

In an embodiment, alternatively or in addition, the at least one processing unit is configured to, while controlling the electromechanical brake and motor controller with the main safety output or the secondary safety output, test the other one of the safety outputs.

In an embodiment, alternatively or in addition, the at least one processing unit is configured to issue an alert when determining a failure with the main safety output or the secondary safety output.

In an embodiment, alternatively or in addition, the passenger transport installation comprises an elevator.

In an embodiment, alternatively or in addition, the passenger transport installation comprises an escalator.

According to a second aspect of the invention, there is provided a passenger transport system comprising an electromechanical brake and motor controller of a passenger transport installation, and a safety circuit controller according to the first aspect.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings:

FIG. 1 illustrates a block diagram of a safety circuit controller for controlling an electromechanical brake and motor controller according to an aspect.

DETAILED DESCRIPTION

FIG. 1 illustrates a block diagram of a safety circuit board 100 for controlling an electromechanical brake and motor controller 104 of a passenger transport installation 110 via a main safety output 108A and a secondary safety output 108B. The safety circuit board 100 comprises at least one processing unit 102A, 102B for controlling operation of the safety circuit board 100. FIG. 1 illustrates an example in which the safety circuit board 100 comprises two processing units. The processing units 102A, 102B may be used so that the processing unit 102A acts as a primary processing unit and the processing unit 102B acts as a backup processing unit in case of the processing unit 102A fails. The safety circuit board 100 may receive signals, for example, from various safety contacts of a passenger transport system 1. For example, the safety circuit board 100 may use safety contact and sensor information from an elevator shaft, a machine room and an elevator car and controls main and brake contactors with a safety output.

The main safety output 108A is associated with a relay connected to the at least one processing unit 102A, 102B. The main safety output 108A also provides a connection to the electromechanical brake and motor control 104. Similarly, the secondary safety output 108B is associated with a relay connected to the at least one processing unit 102A, 102B. Also the secondary safety output provides a connection to the electromechanical brake and motor 104. The main safety output 108A and the secondary safety output 108B are configured in parallel enabling control of the electromechanical brake and motor 104 with the at least one processing unit 102A, 102B using either of the safety outputs 108A, 108B. Once the electromechanical brake and motor controller 104 receives a signal from either of the safety outputs 108A, 108B, it may send a start permit signal 106 to the safety circuit board 100.

As the relays will eventually wear out, the disclosed solution increases the expected lifetime of the safety because the usage of the safety output relays may be divided to two separate safety outputs. Further, in one embodiment, the passenger transport installation may be allowed to continue normal operation for a long time (even years) when there has been detected a permanent failure in one of the safety outputs. The call out can be avoided and the safety circuit board can be replaced during a normal maintenance visit.

In an embodiment, the at least one processing unit 102A, 102B is configured to alternate between the main safety output 108A and the secondary safety output 108B when controlling the electromechanical brake and motor controller 104. In a further embodiment, the used safety output used may be changed to the other one after each normal run of the passenger transport installation. In a further embodiment, the secondary safety output 108B may be used as a backup safety output and is taken into use only after a failure in the main safety output 108A has been detected. In a further embodiment a switch between the main safety output 108A and the secondary safety output 108B may be performed periodically, for example, every one hour.

When a switching process from one safety output to another safety output has been started, an immediate new switching may be disabled. The switching may be allowed again after a successful relay test for the other safety output. If the safety circuit board detects a possible failure in a tested safety output, it may disable switching to this safety output.

In an embodiment, if a test of the main safety output 108A is successful, the main safety output 108A may be selected as the current safety output. Then, if a periodical test of the main safety output 108A fails but a periodical test of the secondary safety output 108B is successful, the secondary safety output 108B may be selected as current safety output.

In an embodiment, the at least one processing unit 102A, 102B may be configured to detect that a switch between the main safety output 108A and the secondary safety output 108B fails and to limit the maximum usage time of the currently used safety output from the main safety output 108A and the secondary safety output. The at least one processing unit 102A, 102B may also be configured to issue a request to stop the passenger transport installation in response to exceeding the maximum usage time. This provides additional safety as the safety circuit board allows the use of the passenger transport installation only for a specified time in a situation in which only one safety input is functional.

In an embodiment the at least one processing unit 102A, 102B is configured to, while controlling the electromechanical brake and motor controller 104 with the main safety output 108A or the secondary safety output 108B, test the other one of the safety outputs. This allows performing relay testing for one safety output at a time.

In an embodiment, the at least one processing unit 102A, 102B is configured to issue an alert when determining a failure with one of the main safety output 108A or the secondary safety output 108B. An immediate maintenance call can be avoided and safety circuit board may be replaced later during a normal maintenance visit.

The passenger transport installation may be, for example, an elevator or an escalator 105. Thus, an elevator system or an escalator system may comprise the above discussed safety circuit board.

Example embodiments may be implemented in software, hardware, application logic or a combination of software, hardware and application logic. The example embodiments can store information relating to various methods described herein. This information can be stored in one or more memories, such as a hard disk, optical disk, magneto-optical disk, RAM, and the like. One or more databases can store the information used to implement the example embodiments. The databases can be organized using data structures (e.g., records, tables, arrays, fields, graphs, trees, lists, and the like) included in one or more memories or storage devices listed herein. The methods described with respect to the example embodiments can include appropriate data structures for storing data collected and/or generated by the methods of the devices and subsystems of the example embodiments in one or more databases.

All or a portion of the example embodiments can be conveniently implemented using one or more general purpose processors, microprocessors, digital signal processors, micro-controllers, and the like, programmed according to the teachings of the example embodiments, as will be appreciated by those skilled in the computer and/or software art(s). Appropriate software can be readily prepared by programmers of ordinary skill based on the teachings of the example embodiments, as will be appreciated by those skilled in the software art. In addition, the example embodiments can be implemented by the preparation of application-specific integrated circuits or by interconnecting an appropriate network of conventional component circuits, as will be appreciated by those skilled in the electrical art(s). Thus, the examples are not limited to any specific combination of hardware and/or software. Stored on any one or on a combination of computer readable media, the examples can include software for controlling the components of the example embodiments, for driving the components of the example embodiments, for enabling the components of the example embodiments to interact with a human user, and the like. Such computer readable media further can include a computer program for performing all or a portion (if processing is distributed) of the processing performed in implementing the example embodiments. Computer code devices of the examples may include any suitable interpretable or executable code mechanism, including but not limited to scripts, interpretable programs, dynamic link libraries (DLLs), Java classes and applets, complete executable programs, and the like. In the context of this document, a "computer-readable medium" may be any media or means that can contain, store, communicate, propagate or transport the instructions for use by or in connection with an instruction execution system, apparatus, or device, such as a computer. A computer-readable medium may include a computer-readable storage medium that may be any media or means that can contain or store the instructions for use by or in connection with an instruction execution system, apparatus, or device, such as a computer. A computer readable medium can include any suitable medium that participates in providing instructions to a processor for execution. Such a medium can take many forms, including but not limited to, non-volatile media, volatile media, transmission media, and the like.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. A safety circuit board for controlling an electromechanical brake and motor controller of a passenger transport installation, the safety circuit board comprising:

at least one processing unit;

a main safety output with an associated relay connected to the at least one processing unit and providing a connection to the electromechanical brake and motor controller; and a secondary safety output with an associated relay connected to the at least one processing unit and providing a connection to the electromechanical brake and motor controller, wherein the main safety output and the secondary safety output are configured in parallel enabling control of the electromechanical brake and motor controller with the at least one processing unit using either of the main safety output and the secondary safety output, and wherein the at least one processing unit is configured to alternately connect between the main safety output and the secondary safety output when connecting and controlling the electromechanical brake and motor controller.

2. The safety circuit board of claim 1, wherein the at least one processing unit is configured to:

switch periodically between the main safety output and the secondary safety output when controlling the electromechanical brake and motor controller.

3. The safety circuit board of claim 2, wherein at least one processing unit is configured to:

detect that a switch between the main safety output and the secondary safety output fails; and limit the maximum usage time of the currently used safety output.

4. The safety circuit board of claim 2, wherein the at least one processing unit is configured to, while controlling the electromechanical brake and motor controller with the main safety output or the secondary safety output, test the other one of the safety outputs.

5. The safety circuit board of claim 2, wherein the passenger transport installation comprises an elevator.

6. The safety circuit board of claim 1, wherein the at least one processing unit is configured to:

detect that a switch between the main safety output and the secondary safety output fails; and limit the maximum usage time of the currently used safety output.

7. The safety circuit board of claim 6, wherein the at least one processing unit is configured to issue a request to stop the passenger transport installation in response to exceeding the maximum usage time.

8. The safety circuit board of claim 7, wherein the at least one processing unit is configured to, while controlling the electromechanical brake and motor controller with the main safety output or the secondary safety output, test the other one of the safety outputs.

9. The safety circuit board of claim 6, wherein the at least one processing unit is configured to, while controlling the electromechanical brake and motor controller with the main safety output or the secondary safety output, test the other one of the safety outputs.

10. The safety circuit board of claim 6, wherein the passenger transport installation comprises an elevator.

11. The safety circuit board of claim 1, wherein the at least one processing unit is configured to:

use the secondary safety output as a backup safety output;

detect a failure with the main safety output; and take the secondary safety output into use in response to detecting the failure with the main safety output.

12. The safety circuit board of claim 11, wherein the at least one processing unit is configured to, while controlling the electromechanical brake and motor controller with the main safety output or the secondary safety output, test the other one of the safety outputs.

13. The safety circuit board of claim 1, wherein the at least one processing unit is configured to, while controlling the electromechanical brake and motor controller with the main safety output or the secondary safety output, test the other one of the safety outputs.

14. The safety circuit board of claim 13, wherein the at least one processing unit is configured to issue an alert when determining a failure with the main safety output or the secondary safety output.

15. The safety circuit board of claim 1, wherein the passenger transport installation comprises an elevator.

16. The safety circuit board of claim 1, wherein the passenger transport installation comprises an escalator.

17. A passenger transport system comprising:

an electromechanical brake and motor controller of a passenger transport installation; and the safety circuit board according to claim 1.

18. The safety circuit board of claim 1, wherein the at least one processing unit is configured in such a manner that a connection between the at least one processing unit and one of the main safety output and the secondary safety output is changed to a connection between the at least one processing unit and the other of the main safety output and the secondary safety output after each normal run of the passenger transport installation.

* * * * *